US010661579B2

(12) United States Patent
Yasuda et al.

(10) Patent No.: US 10,661,579 B2
(45) Date of Patent: May 26, 2020

(54) INKJET PRINTING APPARATUS

(71) Applicant: SCREEN HOLDINGS CO., LTD., Kyoto (JP)

(72) Inventors: Satoshi Yasuda, Kyoto (JP); Tetsuya Ishida, Kyoto (JP); Masayuki Nakano, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/224,190

(22) Filed: Dec. 18, 2018

(65) Prior Publication Data

US 2019/0118549 A1 Apr. 25, 2019

Related U.S. Application Data

(62) Division of application No. 15/470,010, filed on Mar. 27, 2017, now abandoned.

(30) Foreign Application Priority Data

Mar. 28, 2016 (JP) ..... 2016-063118

(51) Int. Cl.
*B41J 2/21* (2006.01)

(52) U.S. Cl.
CPC ..... *B41J 2/2146* (2013.01); *B41J 2/2132* (2013.01)

(58) Field of Classification Search
CPC ..... B41J 2/2132; B41J 2/2146
See application file for complete search history.

(56) References Cited

U.S. PATENT DOCUMENTS

2006/0061617 A1* 3/2006 Udagawa ..... B41J 2/16526 347/23
2006/0274097 A1 12/2006 Fujimoto et al.
2013/0342596 A1* 12/2013 Izawa ..... B41J 2/04503 347/9
2014/0028751 A1* 1/2014 Nishimura ..... B41J 13/0009 347/16

FOREIGN PATENT DOCUMENTS

JP 2013-071389 4/2013

OTHER PUBLICATIONS

Non-Final Office Action issued in related parent U.S. Appl. No. 15/470,010, dated Mar. 28, 2018.
Final Office Action issued in related parent U.S. Appl. No. 15/470,010, dated Aug. 30, 2018.

* cited by examiner

*Primary Examiner* — Alessandro V Amari
*Assistant Examiner* — Kendrick X Liu
(74) *Attorney, Agent, or Firm* — McDermott Will & Emery LLP

(57) ABSTRACT

A printing apparatus comprises: a transport mechanism that transports a recording medium; a first line head group including a first line head in number of N that ejects first ink; a second line head group including a second line head in number of M that ejects second ink; and a controller, where M is a natural number larger than N. The line heads form images along lines extending in a width direction along a surface of the recording medium by ejecting ink droplets from a plurality of nozzles aligned in the width direction. In a first printing step, the controller makes each of the first line head in number of N perform printing process on every N-th line, while making each of the second line heads in number of M perform the printing process on every M-th line.

8 Claims, 11 Drawing Sheets

NORMAL MODE OF MULTIPLE PRINTING STEP
FIRST LINE HEAD GROUP

NORMAL MODE OF MULTIPLE PRINTING STEP
SECOND LINE HEAD GROUP

PARTIALLY HIGH-RESOLUTION MODE OF MULTIPLE PRINTING STEP
FIRST LINE HEAD GROUP

PARTIALLY HIGH-RESOLUTION MODE OF MULTIPLE PRINTING STEP
SECOND LINE HEAD GROUP

HIGH-SPEED MODE OF PARTICULAR PRINTING STEP
SECOND LINE HEAD GROUP

HIGH-RESOLUTION MODE OF PARTICULAR PRINTING STEP
SECOND LINE HEAD GROUP

NORMAL MODE OF MULTIPLE PRINTING STEP
FIRST LINE HEAD GROUP

NORMAL MODE OF MULTIPLE PRINTING STEP
SECOND LINE HEAD GROUP

PARTIALLY HIGH-RESOLUTION MODE OF MULTIPLE PRINTING STEP
FIRST LINE HEAD GROUP

PARTIALLY HIGH-RESOLUTION MODE OF MULTIPLE PRINTING STEP
SECOND LINE HEAD GROUP

NORMAL MODE OF MULTIPLE PRINTING STEP
FIRST LINE HEAD GROUP

NORMAL MODE OF MULTIPLE PRINTING STEP
SECOND LINE HEAD GROUP

INKJET PRINTING APPARATUS

CROSS-REFERENCE TO RELATED APPLICATIONS

This is a Divisional of U.S. patent application Ser. No. 15/470,010, filed on Mar. 27, 2017, which claims the benefit of Japanese Patent Application No. 2016-063118, filed on Mar. 28, 2016 including the specification, drawings and abstract are incorporated herein by reference in their entirety.

BACKGROUND OF THE INVENTION

Field of the Invention

The present invention relates to an inkjet printing apparatus.

Description of the Background Art

In a conventionally-known inkjet printing apparatus employing what is called a one-pass system, a recording medium being transported in a transport direction is caused to pass through only once under a line head that ejects ink. In the inkjet printing apparatus employing such a one-pass system, a larger number of line heads to eject ink should be provided for increasing a processing speed of a printing step without causing reduction in a print resolution.

There has also been a conventionally-known inkjet printing apparatus allowed to eject several types of ink for a purpose such as multi-color printing. Japanese Patent Application Laid-Open No. 2013-71389 describes an example of a conventional inkjet printing apparatus for multi-color printing. The printing apparatus described in Japanese Patent Application Laid-Open No. 2013-71389 includes line heads prepared for respective types of ink for multi-color printing. This printing apparatus has the same number of line heads for each type of ink.

Each nozzle of a line head is not allowed to eject ink at a time interval shorter than a fixed period. In this regard, if a speed of transporting a recording medium is increased for the purpose of increasing a processing speed in a conventional inkjet printing apparatus, a print resolution is reduced. This leads to reduction in a print quality. Meanwhile, if a print resolution is increased for the purpose of increasing a print quality, a speed of transporting the recording medium is reduced. This leads to reduction in a processing speed.

In an inkjet printing apparatus using several types of ink, more line heads for ejecting each of these types of ink may be prepared for the purpose of increasing a processing speed of a printing step without causing reduction in a print resolution. However, this additionally causes size increase of the inkjet printing apparatus.

In general, reducing a print resolution of fine letters or a significant pattern is likely to cause reduction in a print quality. By contrast, reduction in a print resolution is less noticeable in a relatively large pattern such as a background. In this case, reduction in a print resolution is unlikely to cause reduction in a print quality.

Thus, for printing of an image including a combination of letters, etc. of a particular color and a pattern such as a background, reducing a print resolution about a type of ink different from ink of the particular color without causing reduction in a print resolution about the ink of the particular color makes it possible to restrict reduction in a print quality, compared to reducing print resolutions about all of the types of color. Further, increasing a print resolution only about the ink of the particular color while setting a print resolution about the different type of ink at a conventional level makes it possible to increase a print quality of an entire image.

SUMMARY OF THE INVENTION

The present invention has been made in view of the above-described circumstances. It is an object of the present invention to provide a technique to be employed for an inkjet printing apparatus that executes a multiple printing step by using several types of ink. This technique is to increase a print quality while restricting reduction in a processing speed of a printing step as well as to restrict size increase of the apparatus.

To achieve the aforementioned object, a first aspect of the present invention is intended for an inkjet printing apparatus that performs printing process of printing an image by ejecting an ink droplet from a nozzle on a recording medium being transported. The printing apparatus comprises: a transport mechanism that transports the recording medium in a transport direction; a first line head group including a first line head in number of N that ejects first ink; a second line head group including a second line head in number of M that ejects second ink; and a controller that controls the operations of the transport mechanism, the first line head, and the second line head, where N is a natural number of 1 or more, and M is a natural number larger than N. The first line head and the second line head each include a plurality of nozzles aligned in a width direction. The first line head and the second line heads each form images along lines by ejecting ink droplets from the nozzles. The lines are regions extending in the width direction along a surface of the recording medium. The first line head and the second line heads are arranged to be spaced from each other in the transport direction. The controller executes a first printing step of making both the first line head group and the second line head group perform the printing process. In the first printing step, each of the first line head in number of N performs the printing process on every N-th line out of lines aligned in the transport direction, and each of the second line heads in number of M performs the printing process on every M-th line out of the lines aligned in the transport direction.

According to the first aspect of the present invention, only the number of line heads responsible for part of the several types of ink is increased, so that a print produced by using this type of ink is allowed to have a high resolution. Thus, a print quality is increased while reduction in a processing speed of a printing step is restricted. Further, size increase of the apparatus is restricted.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings. In the below, a direction in which printing paper 9 is transported is called a "transport direction," and a horizontal direction orthogonal to the transport direction is called a "width direction."

<1. Configuration of Printing Apparatus>

Figure 1:
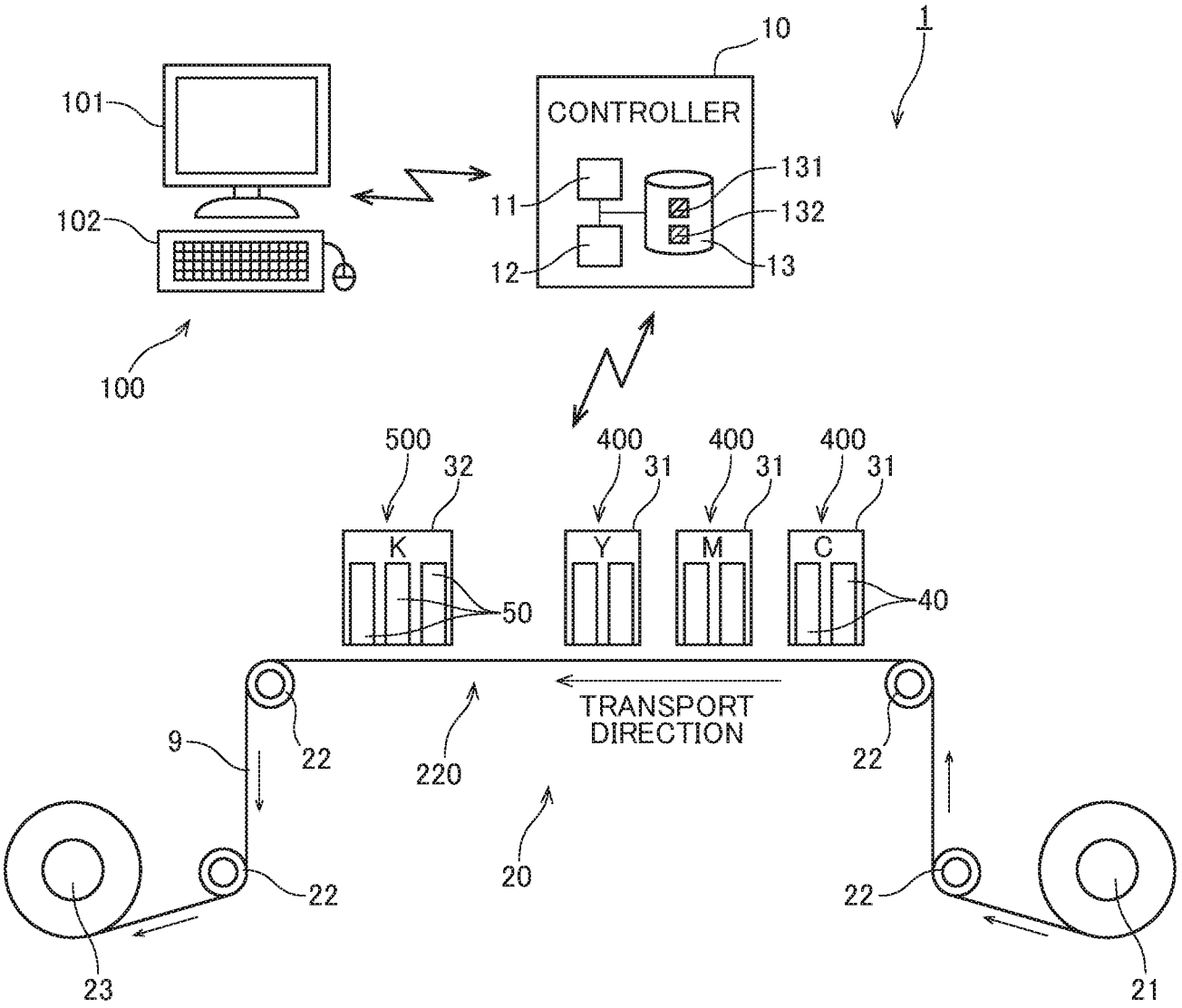
FIG. 1 conceptually shows the configuration of a printing apparatus.
Figure 2:
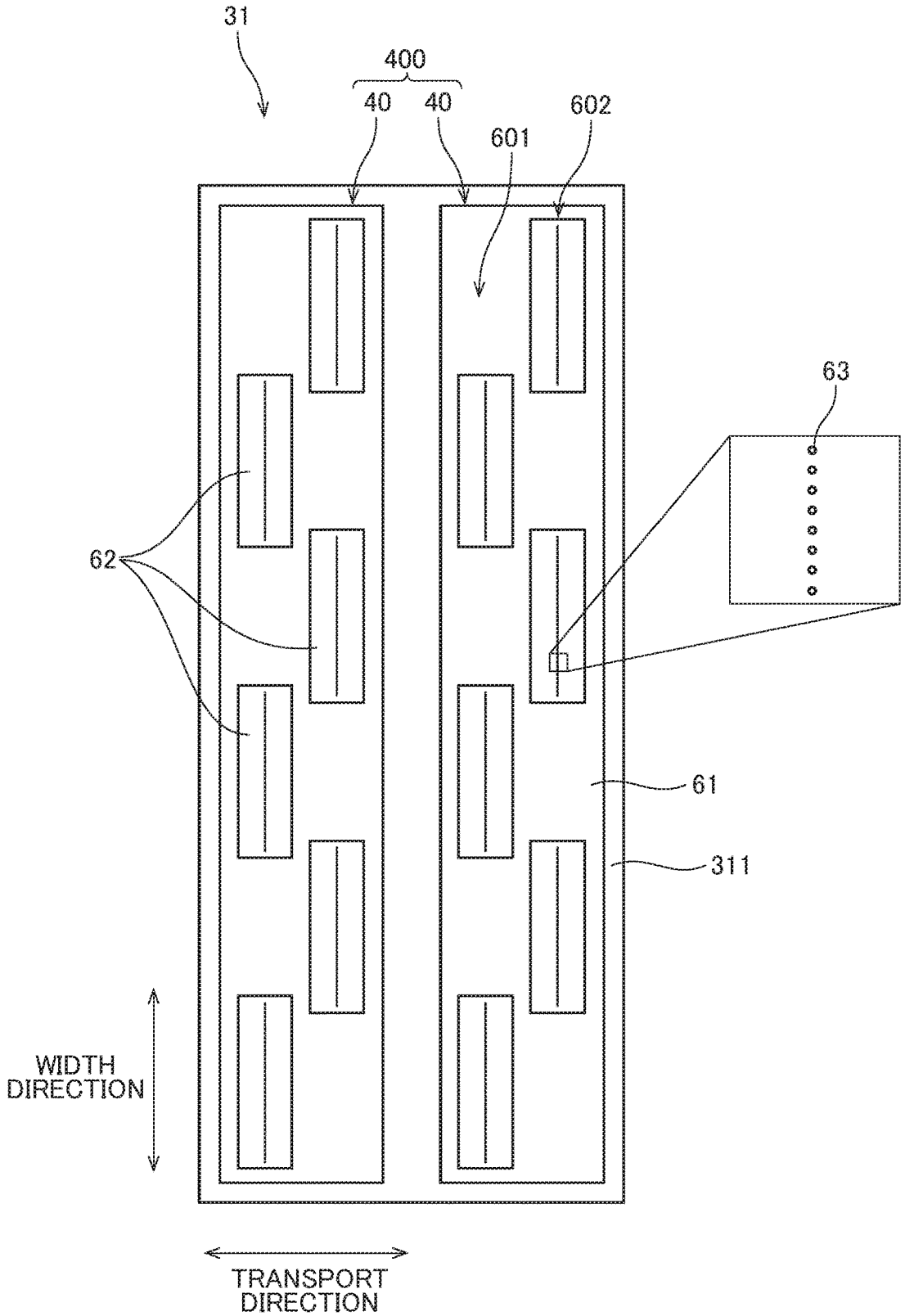
FIG. 2 is a bottom view of a first head unit.
Figure 3:
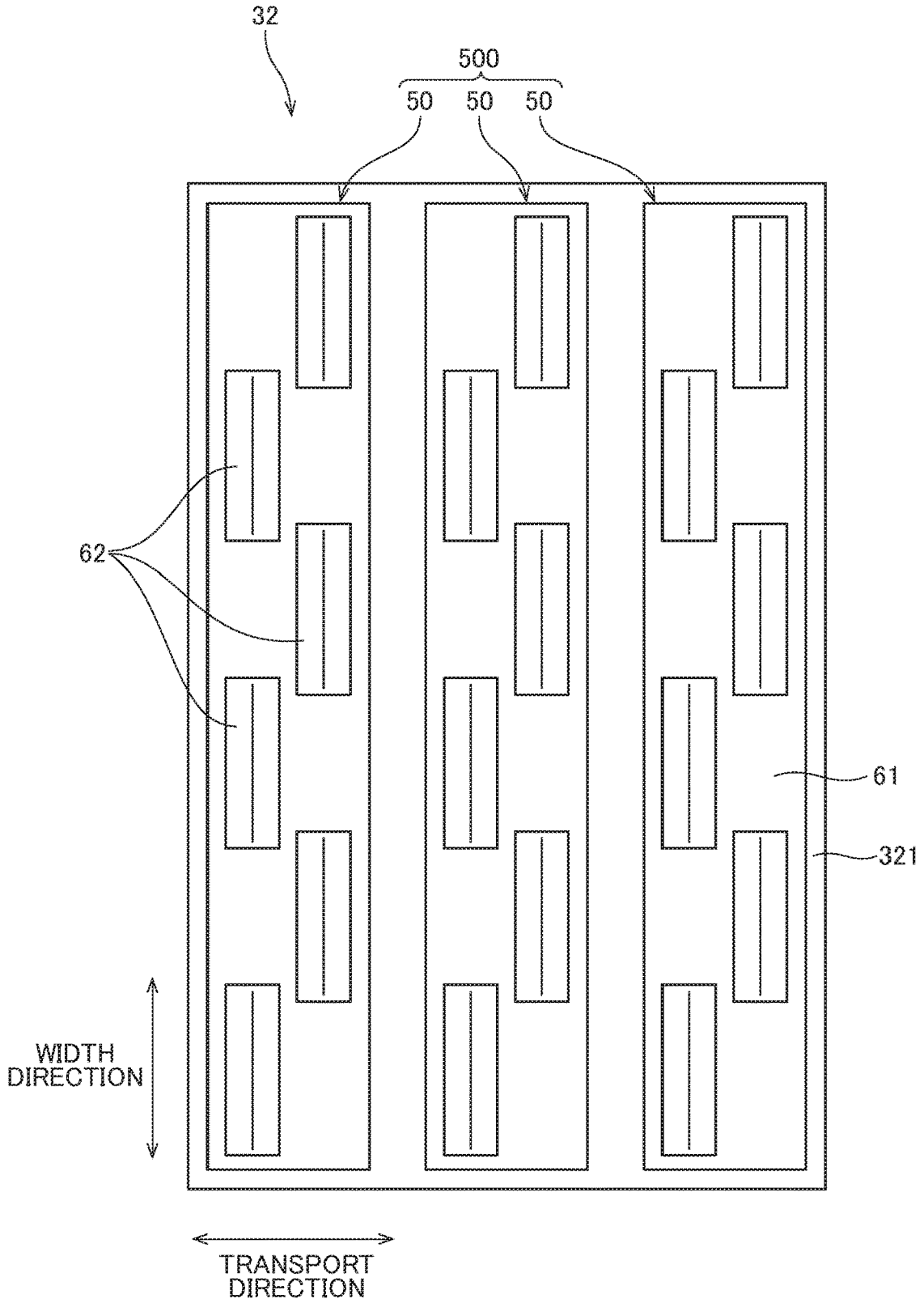
FIG. 3 is a bottom view of a second head unit.

FIG. 1 conceptually shows the configuration of a printing apparatus 1 according to a preferred embodiment of the present invention. FIG. 2 is a bottom view of a first head unit 31. FIG. 3 is a bottom view of a second head unit 32.

The printing apparatus 1 is an inkjet printing apparatus that records a multi-color image on the printing paper 9 as an elongated strip-shaped recording medium by ejecting ink droplets onto the printing paper 9 from a plurality of line heads 40 and 50 in a head unit 31 and 32 while transporting the printing paper 9. As shown in FIG. 1, the printing apparatus 1 includes a transport mechanism 20, three first head units 31, one second head unit 32, a controller 10, and an operation unit 100.

The transport mechanism 20 is a mechanism for transporting the printing paper 9 in the transport direction along the longitudinal direction of the printing paper 9 while holding the printing paper 9. The transport mechanism 20 of this preferred embodiment includes an unwinding part 21, a plurality of transport rollers 22, and a winding part 23.

A motor as a power source (not shown in the drawings) is connected to the unwinding part 21, the transport rollers 22, and the winding part 23. The unwinding part 21, the transport rollers 22, and the winding part 23 are each rotated by driving of the motor by the controller 10. Some or all of the transport rollers 22 may be follower rollers that are not coupled to the motor but are to rotate to follow the motion of the printing paper 9.

The transport rollers 22 form a transport path of the printing paper 9. Each transport roller 22 rotates about a horizontal axis to guide the printing paper 9 downstream along the transport path. As the printing paper 9 contacts the transport rollers 22, tension is applied to the printing paper 9. In this way, the printing paper 9 is unwound from the unwinding part 21 and transported along the transport path formed of the transport rollers 22 to the winding part 23. After being transported, the printing paper 9 is collected on the winding part 23.

The three first head units 31 and the one second head unit 32 are arranged above the transport path of the printing paper 9 while being spaced at intervals in the transport direction. The three first head units 31 eject ink droplets of corresponding colors including cyan (C), magenta (M), and yellow (Y) onto the upper surface of the printing paper 9. The second head unit 32 ejects ink droplets of black (K) onto the upper surface of the printing paper 9.

The printing apparatus 1 is a recording apparatus employing what is called a one-pass system of recording an intended image pattern on the printing paper 9 by ejecting ink droplets from each of the head units 31 and the head unit 32 while causing the printing paper 9 to pass through only once under each of the head units 31 and the head unit 32.

The first head unit 31 is a head unit that ejects ink droplets of first ink. In this preferred embodiment, three types of ink of colors including cyan (C), magenta (M), and yellow (Y) are used as the first ink. As shown in FIG. 2, the first head unit 31 includes a case 311 and two first line heads 40 attached to the case 311.

The second head unit 32 is a head unit that ejects ink droplets of second ink. In this preferred embodiment, ink of black (K) is used as the second ink. As shown in FIG. 3, the second head unit 32 includes a case 321 and three second line heads 50 attached to the case 321.

As shown in FIG. 2, the first line head 40 includes a head holder 61 and a plurality of ejection heads 62 attached to the head holder 61. Each ejection head 62 has a plurality of nozzles 63 at its lower surface functioning as an ejection surface. The nozzles 63 are arranged at positions shifted from each other in the width direction. One nozzle 63 is allocated to a region having a width corresponding to one pixel on the printing paper 9.

The ejection heads 62 are arranged in a staggered pattern (alternately at diagonally opposite positions) in the width direction. Specifically, the ejection heads 62 include a first ejection head line 601 extending in the width direction and a second ejection head line 602 extending in the width direction. The second ejection head line 602 is located at a downstream position relative to the first ejection head line 601. The ejection heads 62 in the first ejection head line 601 and the ejection heads 62 in the second ejection head line 602 are arranged alternately in the width direction. By arranging the ejection heads 62 in such a staggered pattern, all the nozzles 63 are arranged densely in the width direction. In this way, the nozzles 63 are aligned in the width direction in each of the first line heads 40.

As shown in FIG. 3, the second line head 50 includes a head holder 61 and a plurality of ejection heads 62 attached to the head holder 61. The configuration of the second line head 50 is substantially the same as that of the first line head 40, so that it will not be described here.

In this preferred embodiment, the two first line heads 40 in the first head unit 31 at the most upstream position ejects ink of cyan (C). The two first line heads 40 in one of the three first head units 31, which is arranged at the center in the transport direction, ejects ink of magenta (M). The two first line heads 40 in the first head unit 31 at the most downstream position ejects ink of yellow (Y). Specifically, the two first line heads 40 in each of the first head units 31 eject the same type of first ink.

These first line heads 40 in number of N (N is a natural number of 1 or more), that eject the same type of first ink are called a first line head group 400. The printing apparatus 1 of this preferred embodiment includes three first line head groups 400 that eject three types of first ink of corresponding colors including cyan (C), magenta (M), and yellow (Y). Each of the first line head groups 400 has the two first line heads 40.

The three second line heads 50 in the second head unit 32 eject the same type of second ink. These second line heads 50 in number of M (M is a natural number larger than N) that eject the same type of second ink are called a second line head group 500. The printing apparatus 1 of this preferred embodiment includes one second line head group 500 that ejects the second ink of black (K). The second line head group 500 has the three second line heads 50.

The controller 10 is a unit for controlling the operation of each structure in the printing apparatus 1. As conceptually shown in FIG. 1, the controller 10 of this preferred embodiment is formed of a computer including an arithmetic processor 11 such as a CPU, a memory 12 such as a RAM, and a storage 13 such as a hard disk drive. The controller 10 is electrically connected to each of the transport mechanism 20, the first head units 31, the second head unit 32, and the operation unit 100.

The controller 10 reads a computer program 131 and data 132 from the storage 13 and stores the read computer program 131 and data 132 on the memory 12 temporarily. Then, the arithmetic processor 11 performs arithmetic processing based on the computer program 131 and the data 132, thereby controlling the operation of each structure in the printing apparatus 1. As a result, a printing step proceeds in the printing apparatus 1. The controller 10 may alternatively be formed of an electronic circuit.

The operation unit 100 includes a display part 101 and an input part 102. Information such as an operating condition about the printing apparatus 1 input from the controller 10 is displayed on the display part 101. An operator is allowed to give the controller 10 a command through the input part 102. A liquid crystal display is used as the display part 101, for example. A keyboard and a mouse are used as the input part 102, for example. The display part 101 and the input part 102 forming the operation unit 100 of this preferred embodiment are separate parts both independent of the printing apparatus 1. Alternatively, the operation unit 100 may be a touch-panel unit including the display part 101 and the input part 102 as an integrated unit and this operation unit 100 may be attached to the body of the printing apparatus 1.

For implementation of the printing step by the printing apparatus 1, while the transport mechanism 20 transports the printing paper 9, ink droplets are ejected from each of the head units 31 and the head unit 32 onto the upper surface of the printing paper 9. The head units 31 and the head unit 32 each include the nozzles 63 for ejection of ink droplets provided at positions facing the substantially entire width of the upper surface of the printing paper 9. This allows each of the head units 31 and the head unit 32 to eject ink droplets onto the upper surface of the printing paper 9 so as to cover the substantially entire width of the upper surface.

In the below, a region of the upper surface of the printing paper 9 where an image is formed by one ejection of ink droplets from all nozzles 63 of one line head 40 or one line head 50 is called a "line." The line is a strip-shaped region extending in the width direction on the printing paper 9. In the line, regions to receive ink droplets ejected from each of the nozzles 63 of one line head 40 or one line head 50 are aligned in the width direction. In the printing apparatus 1, the line head 40 and the line head 50 each form images along a plurality of lines on the printing paper 9. These images formed along the corresponding lines are combined to form an intended image on the upper surface of the printing paper 9.

The printing step executed by the printing apparatus 1 can be switched between a multiple printing step and a particular printing step. In the multiple printing step, both the first line head groups 400 and the second line head group 500 perform printing process. In the particular printing step, the second line head group 500 performs printing process while printing process by the first line head groups 400 is stopped.

For implementation of the multiple printing step by the printing apparatus 1, the controller 10 makes each of the first line heads 40 in each of the three first head units 31 responsible for the corresponding colors and each of the second line heads 50 in the second head unit 32 eject ink droplets. As a result, a multi-color pattern is formed on the upper surface of the printing paper 9.

For implementation of the particular printing step by the printing apparatus 1, the controller 10 makes each of the second line heads 50 in the second head unit 32 responsible for black (K) eject ink droplets. As a result, a single-color pattern is formed on the upper surface of the printing paper 9.

<2. Printing Step>

Each printing step executed by the printing apparatus 1 will be described next with reference to FIGS. 4 to 9. In the printing apparatus 1, a mode of the multiple printing step is selectable between two modes: a normal mode and a partially high-resolution mode. In the printing apparatus 1, a mode of the particular printing step is selectable between two modes: a high-speed mode and a high-resolution mode.

As described above, in the printing apparatus 1, the controller 10 is allowed to make a switch among the following printing steps: the partially high-resolution mode of the multiple printing step (first printing step); the normal mode of the multiple printing step (second printing step); the high-speed mode of the particular printing step (third printing step); and the high-resolution mode of the particular printing step (fourth printing step).

Figure 4:
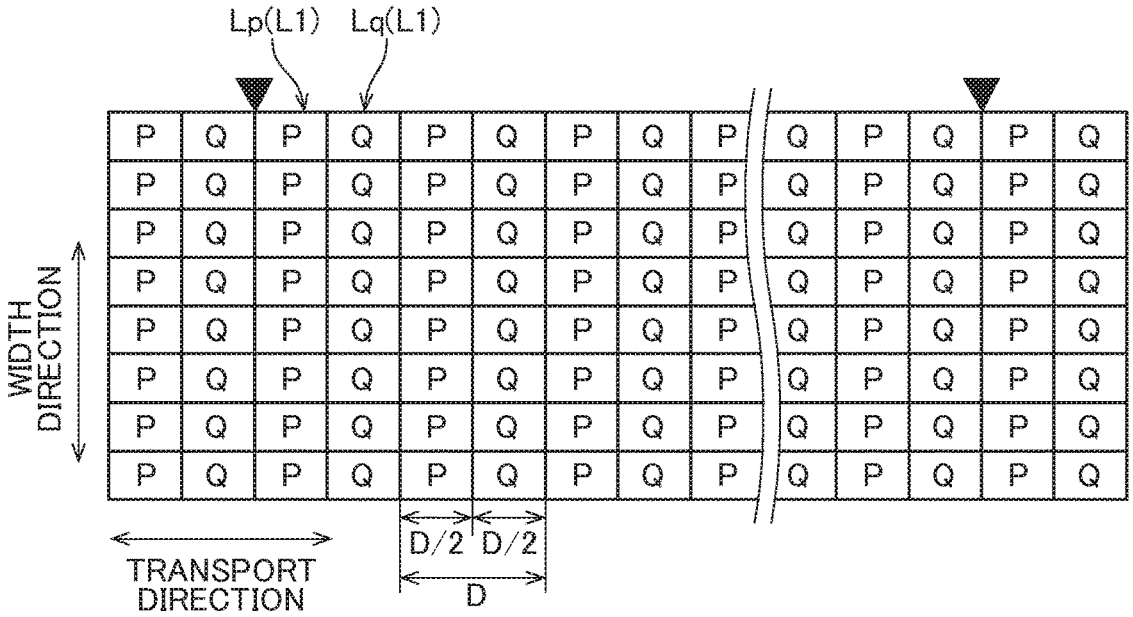
FIGS. 4 and 5 each conceptually show exemplary line arrangement on a recording medium in a normal mode of a multiple printing step.
Figure 5:
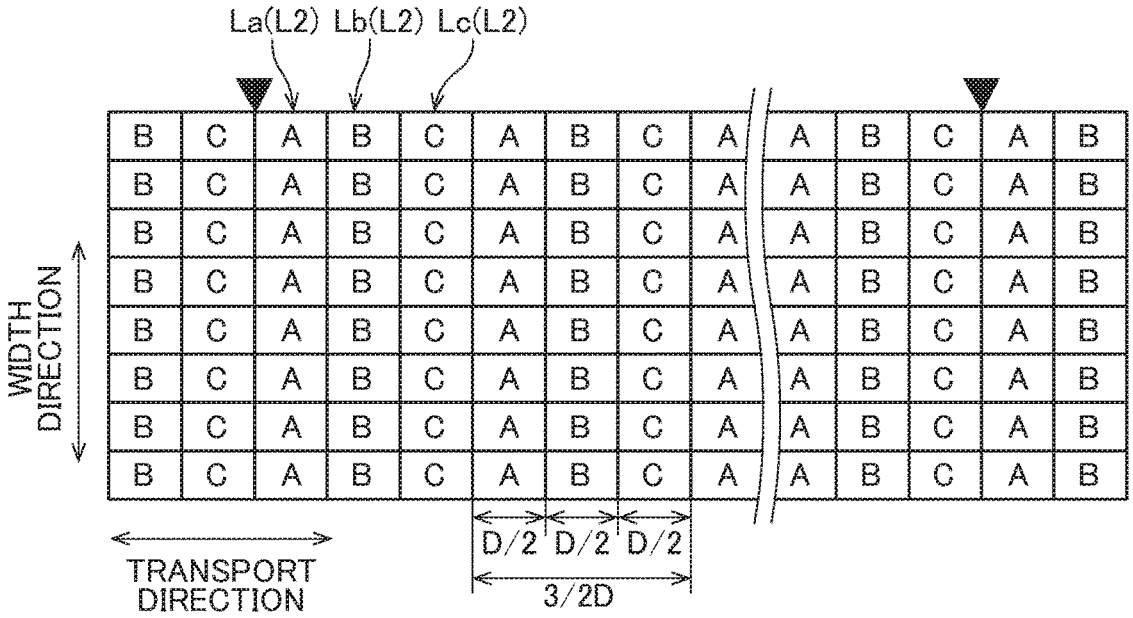

FIGS. 4 and 5 each conceptually show exemplary line arrangement on the printing paper 9 in the normal mode of the multiple printing step. More specifically, FIG. 4 shows line arrangement determined by the first line head group 400 and FIG. 5 shows line arrangement determined by the second line head group 500.

Figure 6:
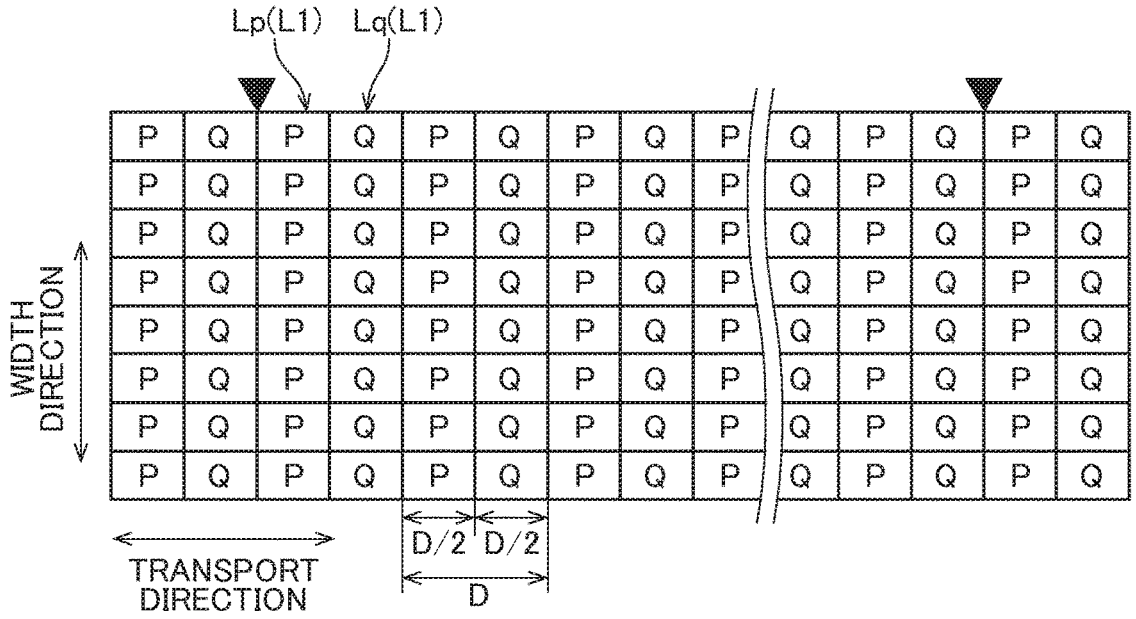
FIGS. 6 and 7 each conceptually show exemplary line arrangement on the recording medium in a partially high-resolution mode of the multiple printing step.
Figure 7:
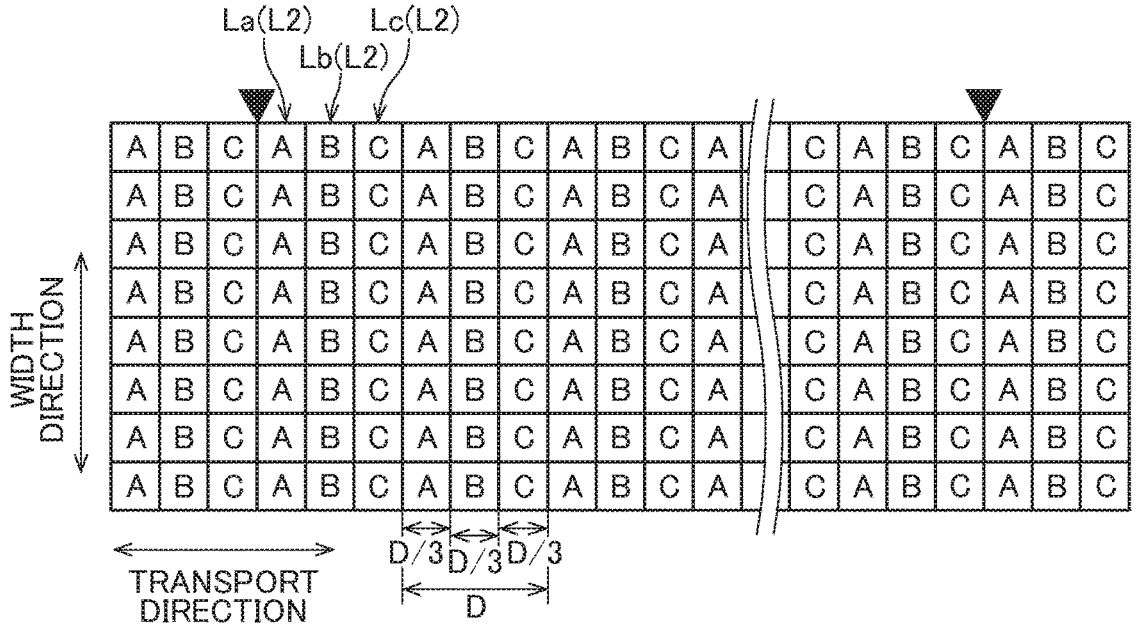

FIGS. 6 and 7 each conceptually show exemplary line arrangement on the printing paper 9 in the partially high-resolution mode of the multiple printing step. More specifically, FIG. 6 shows line arrangement determined by the first line head group 400 and FIG. 7 shows line arrangement determined by the second line head group 500.

Figure 8:
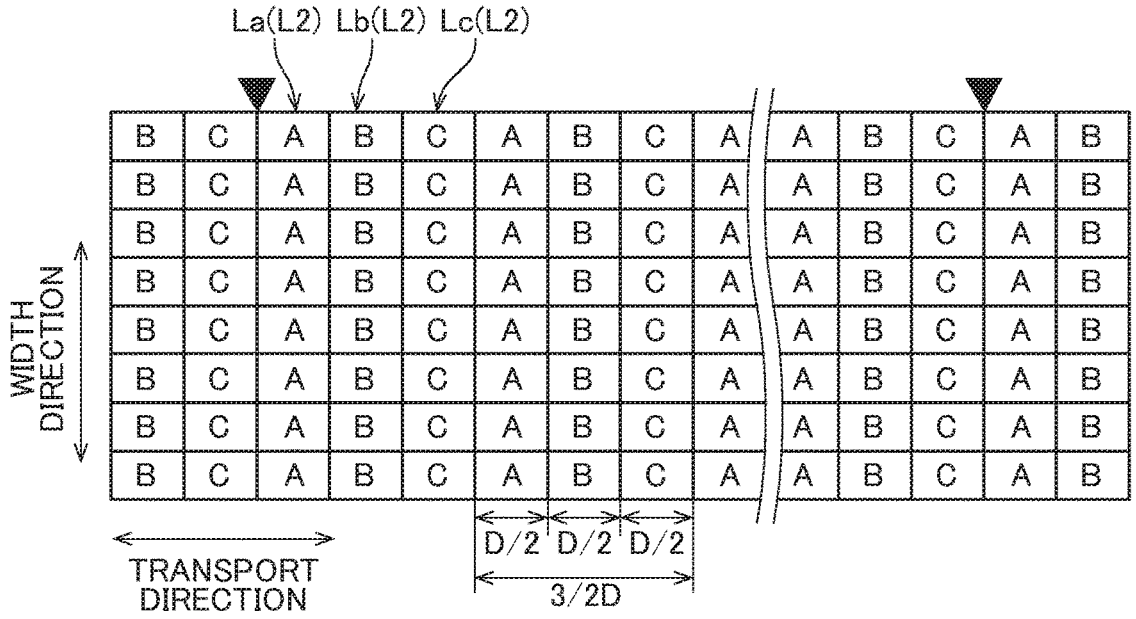
FIG. 8 conceptually shows exemplary line arrangement on the recording medium in a high-speed mode of a particular printing step.
Figure 9:
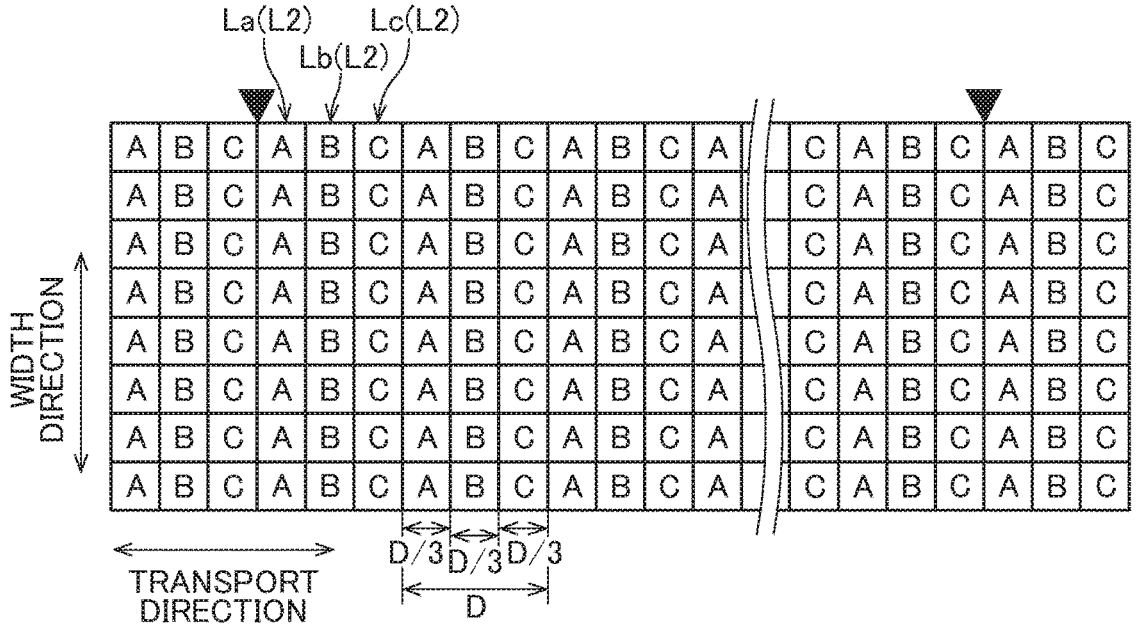
FIG. 9 conceptually shows exemplary line arrangement on the recording medium in a high-resolution mode of the particular printing step.

FIG. 8 conceptually shows exemplary line arrangement on the printing paper 9 in the high-speed mode of the particular printing step determined by the second line head group 500. FIG. 9 conceptually shows exemplary line arrangement on the printing paper 9 in the high-resolution mode of the particular printing step determined by the second line head group 500.

Referring to FIGS. 4 to 9, a region on the printing paper 9 to receive an ink droplet ejected from each nozzle 63 is shown as a rectangular partitioned region. Referring to FIGS. 4 to 9, page breaks on the printing paper 9 are shown by reverse triangles in black.

Referring to FIGS. 4 and 6, a sign "P" is given to a region to receive an ink droplet ejected from each nozzle 63 of one of the two first line heads 40. A sign "Q" is given to a region to receive an ink droplet ejected from each nozzle 63 of the other of the two first line heads 40. Referring to FIGS. 5 and 7 to 9, a sign "A" is given to a region to receive an ink droplet ejected from each nozzle 63 of one of the three second line heads 50. A sign "B" is given to a region to receive an ink droplet ejected from each nozzle 63 of a different one of the three second line heads 50. A sign "C" is given to a region to receive an ink droplet ejected from each nozzle 63 of the other of the three second line heads 50.

All the nozzles 63 of each of the first line heads 40 and the second line heads 50 are spaced at such intervals as to obtain a print resolution of 600 dpi in the width direction. This makes it possible to obtain a print resolution of 600 dpi in the width direction with any type of a printing step and any type of a mode of the printing step.

A print resolution of an image in the transport direction formed by each of the line heads 40 and 50 depends on a speed of transporting the printing paper 9 and a time interval between ejections of ink droplets from all the nozzles 63 of each of the line heads 40 and 50. Specifically, a print resolution of an image in the transport direction formed by one of the first line heads 40 depends on a speed of transporting the printing paper 9 and a time interval between ejections of ink droplets from all the nozzles 63 of the one of the first line heads 40. A print resolution of an image in the transport direction formed by one of the second line heads 50 depends on a speed of transporting the printing paper 9 and a time interval between ejections of ink droplets from all the nozzles 63 of the one of the line heads 50.

Each of the line heads 40 and 50 is capable of ejecting ink droplets on every period T [μs]. Each of the line heads 40 and 50 is a line head capable of producing a print at a print resolution of 200 dpi in the transport direction by ejecting ink droplets corresponding to one line on every period T [μs] onto the printing paper 9 being transported at a normal transport speed V [μm/μs]. A cycle of a line appearing on the plane of the printing paper 9 is calculated as follows: distance D [μm]=V [μm/μs]*T [μs].

In the printing apparatus 1, the first line head group 400 including the two first line heads 40 is capable of ejecting ink droplets corresponding to two lines on every period T [μs] by ejecting the ink droplets from the two first line heads 40. This makes it possible to produce a print at a print resolution of 400 dpi in the transport direction at the normal transport speed V [μm/μs].

Likewise, the second line head group 500 including the three second line heads 50 is capable of ejecting ink droplets corresponding to three lines on every period T [μs] by ejecting the ink droplets from the three second line heads 50. This makes it possible to produce a print at a print resolution of 600 dpi in the transport direction at the normal transport speed V [μm/μs].

In the below, each of the normal mode of the multiple printing step, the partially high-resolution mode of the multiple printing step, the high-speed mode of the particular printing step, and the high-resolution mode of the particular printing step will be described with reference to FIGS. 4 to 9.

The multiple printing step will be described first. The multiple printing step is a full-color printing step executed by both the first line head groups 400 and the second line head group 500. A transport speed employed during the multiple printing step is the normal transport speed V [μm/μs]. In the normal mode of the multiple printing step, a print is produced while print resolutions about the three colors including cyan (C), magenta (M), and yellow (Y) in the transport direction determined by the three first line head groups 400, and a print resolution about black (K) determined by the second line head group 500, are all equally set at 400 dpi.

As shown in FIG. 4, in the normal mode of the multiple printing step, images are formed along a plurality of lines L1 aligned in the transport direction on the plane of the printing paper 9 by the first line head group 400. The lines L1 include lines Lp and lines Lq. The line Lp includes regions P aligned in the width direction that are to receive ink droplets ejected from one of the two first line heads 40. The line Lq includes regions Q aligned in the width direction that are to receive ink droplets ejected from the other of the two first line heads 40. The lines Lp and the lines Lq are formed alternately in the transport direction.

As shown in FIG. 5, images are formed along a plurality of lines L2 aligned in the transport direction on the plane of the printing paper 9 by the second line head group 500. The lines L2 include lines La, lines Lb, and lines Lc. The line La includes regions A aligned in the width direction that are to receive ink droplets ejected from one of the three second line heads 50. The line Lb includes regions B aligned in the width direction that are to receive ink droplets ejected from a different one of the three second line heads 50. The line Lc includes regions C aligned in the width direction that are to receive ink droplets ejected from the other of the three second line heads 50. The lines La, the lines Lb, and the lines Lc are arranged sequentially and repeatedly in the transport direction.

In the normal mode of the multiple printing step, each of the two first line heads 40 forms an image along the line Lp or Lq on every period T [μs]. Specifically, each of the two first line heads 40 performs printing process on every two lines L1. Thus, as shown in FIG. 4, a cycle of the line Lp and the line Lq in the transport direction is calculated as follows: distance D [μm]=V [μm/μs]*T [μs]. Thus, a cycle of the line L1 in the transport direction is calculated as follows: distance 1/2·D [μm]=D [μm]/2. As a result, an image formed by the first line head group 400 has a print resolution of 400 dpi in the transport direction.

Each of the three second line heads 50 forms an image along the line La, Lb, or Lc on every period of 3/2·T [μs]. Specifically, each of the three second line heads 50 performs printing process on every two lines L2. Thus, as shown in FIG. 5, a cycle of the line La, the line Lb, and the line Lc in the transport direction is calculated as follows: distance 3/2·D [μm]=V [μm/μs]*3/2·T [μs]. Thus, a cycle of the line L2 in the transport direction is calculated as follows: distance 1/2·D [μm]=(3/2·D [μm])/3. As a result, an image formed by the second line head group 500 has a print resolution of 400 dpi in the transport direction.

As described above, in the normal mode of the multiple printing step, an image formed by the first line head group 400 and an image formed by the second line head group 500 have the same print resolution in the transport direction. Specifically, the first line head group 400 and the second line head group 500 form images along the same number of lines per page of the printing paper 9.

To make the second line head group 500 perform printing process at the same resolution as the first line head group 400, the number of the second line heads 50 used may be at least the same number as the first line heads 40 belonging to the first line head group 400. In this case, in the normal mode of the multiple printing step, printing process can be performed by using only two of the three second line heads 50.

If part of the second line heads 50 stops for a long time, however, the nozzles 63 of this second line head 50 may be exposed to a risk such as clogging with evaporated and solidified ink. By contrast, according to this preferred embodiment, the three second line heads 50 are used by turns in the normal mode. Thus, in this preferred embodiment, there will be no second line head 50 to be stopped for a long time, thereby reducing the likelihood of clogging of the nozzle 63 of the second line heads 50.

The partially high-resolution mode of the multiple printing step will be described next. In the partially high-resolution mode of the multiple printing step, a print is produced while print resolutions about the three colors including cyan (C), magenta (M), and yellow (Y) in the transport direction determined by the three first line head groups 400 are set at 400 dpi. Further, the print is produced while a print resolution about black (K) in the transport direction determined by the second line head group 500 is set at 600 dpi. Like in the normal mode, the normal transport speed V [μm/μs] is employed in the partially high-resolution mode.

As shown in FIG. 6, in the partially high-resolution mode of the multiple printing step, images are formed along a plurality of lines L1 aligned in the transport direction on the plane of the printing paper 9 by the first line head group 400. Like in the normal mode, the lines L1 include lines Lp and lines Lq arranged alternately. As shown in FIG. 7, images are formed along a plurality of lines L2 aligned in the transport direction on the plane of the printing paper 9 by the second line head group 500. Like in the normal mode, the lines L2 include lines La, lines Lb, and lines Lc arranged sequentially and repeatedly in the transport direction.

In the partially high-resolution mode of the multiple printing step, like in the normal mode, each of the two first line heads 40 forms an image along the line Lp or Lq on every period T [μs]. Specifically, each of the two first line heads 40 performs printing process on every two lines L1. Thus, an image formed by the first line head group 400 has a print resolution of 400 dpi in the transport direction.

Each of the three second line heads 50 forms an image along the line La, Lb, or Lc on every period T [μs]. Specifically, each of the three second line heads 50 performs printing process on every three lines L2. Thus, as shown in FIG. 7, a cycle of the line La, the line Lb, and the line Lc in the transport direction is calculated as follows: distance D [μm]=V [μm/μs]*T [μs]. Thus, a cycle of the line L2 in the transport direction is calculated as follows: distance 1/3·D [μm]=D [μm]/3. As a result, an image formed by the second line head group 500 has a print resolution of 600 dpi in the transport direction.

As described above, in the partially high-resolution mode of the multiple printing step, an image formed by the second line head group 500 has a print resolution in the transport direction higher than that of an image formed by the first line head group 400. This achieves increase in a print quality efficiently without causing reduction in a speed of transporting the printing paper 9.

More specifically, an image formed by the second line head group 500 has a print resolution in the transport direction that is 3/2 times that of an image formed by the first line head group 400. This ratio in a print resolution is expressed as M/N times, where N is the number of the first line heads 40 belonging to the first line head group 400, and M is the number of the second line heads 50 belonging to the second line head group 500. In this way, an image formed by the second line head group 500 is allowed to have a highest print resolution in the transport direction without causing reduction in a speed of transporting the printing paper 9.

The partially high-resolution mode achieves increase in a resolution of an image formed by using ink of black (K) without causing reduction in a speed of transporting the printing paper 9. Thus, if an image to be printed has a multi-color image section and a black letter section, for example, the black letter section is printed at a high resolution. This achieves increase in a print quality without causing reduction in a processing speed of a printing step.

The particular printing step will be described next. The particular printing step is a single-color printing step of driving the second line head group 500 while stopping the first line head groups 400. In the high-speed mode of the particular printing step, a print is produced while a print resolution about black (K) in the transport direction determined by the second line head group 500 is set at 400 dpi. A high-speed transport speed 3/2·V [μm/μs] is employed in the high-speed mode.

As shown in FIG. 8, in the high-speed mode of the particular printing step, images are formed along a plurality of lines L2 aligned in the transport direction on the plane of the printing paper 9 by the second line head group 500. The lines L2 include: lines La each including regions A aligned in the width direction that are to receive ink droplets ejected from one of the three second line heads 50; lines Lb each including regions B aligned in the width direction that are to receive ink droplets ejected from a different one of the three second line heads 50; and lines Lc each including regions C aligned in the width direction that are to receive ink droplets ejected from the other of the three second line heads 50. The lines La, the lines Lb, and the lines Lc are arranged sequentially and repeatedly in the transport direction.

In the high-speed mode of the particular printing step, each of the three second line heads 50 forms an image along the line La, Lb, or Lc on every period T [μs]. Thus, as shown in FIG. 8, a cycle of the line La, the line Lb, and the line Lc in the transport direction is calculated as follows: 3/2·D [μm]=3/2·V [μm/μs]*T [μs]. Thus, a cycle of the line L2 in the transport direction is calculated as follows: distance 1/2·D [μm]=(3/2·D [μm])/3. As a result, an image formed by the second line head group 500 has a print resolution of 400 dpi in the transport direction.

In the high-speed mode of the particular printing step, the printing paper 9 is transported at the speed 3/2·V [μm/μs] higher than the speed V [μm/μs] employed for transporting the printing paper 9 in the multiple printing step. This allows transport of the printing paper 9 at a higher speed without causing reduction in a resolution of an image in the transport direction formed by the second line head group 500.

More specifically, the speed 3/2·V [μm/μs] of transporting the printing paper 9 employed in the high-speed mode of the particular printing step is 3/2 times the speed V [μm/μs] of transporting the printing paper 9 employed in the multiple printing step. This ratio in a transport speed is expressed as M/N times, where N is the number of the first line heads 40 belonging to the first line head group 400, and M is the number of the second line heads 50 belonging to the second line head group 500. In this way, the printing paper 9 is allowed to be transported at a highest speed without causing reduction in a resolution of an image in the transport direction formed by the second line head group 500.

In the high-resolution mode of the particular printing step, a print is produced while a print resolution about black (K) in the transport direction determined by the second line head group 500 is set at 600 dpi. The normal transport speed V [μm/μs] is employed in the high-resolution mode.

As shown in FIG. 9, in the high-resolution mode of the particular printing step, images are formed along a plurality of lines L2 aligned in the transport direction on the plane of the printing paper 9 by the second line head group 500. Like in the multiple printing step, the lines L2 include lines La, lines Lb, and lines Lc are arranged sequentially and repeatedly in the transport direction.

In the high-resolution mode of the particular printing step, each of the three second line heads 50 forms an image along the line La, Lb, or Lc on every period T [μs]. Thus, as shown in FIG. 9, a cycle of the line La, the line Lb, and the line Lc in the transport direction is calculated as follows: D [μm]=V [μm/μs]*T [μs]. Thus, a cycle of the line L2 in the transport direction is calculated as follows: distance 1/3·D [μm]=D [μm]/3. As a result, an image formed by the second line head group 500 has a print resolution of 600 dpi in the transport direction.

As described above, in the high-resolution mode of the particular printing step, an image formed by the second line head group 500 has a print resolution in the transport direction higher than that of an image formed by the first line head group 400 in the multiple printing step. In this way, the high-resolution mode of the particular printing step achieves increase in a resolution of an image formed by the second line head group 500 without causing reduction in a speed of transporting the printing paper 9. This allows printing of an image at a high resolution that requires only the second line head group 500 for the formation of this image.

More specifically, in the high-resolution mode of the particular printing step, an image formed by the second line head group 500 has a print resolution in the transport direction that is 3/2 times that of an image formed by the first line head group 400 in the multiple printing step. This ratio in a print resolution is expressed as M/N times, where N is the number of the first line heads 40 belonging to the first line head group 400, and M is the number of the second line heads 50 belonging to the second line head group 500. In this way, an image formed by the second line head group 500 is allowed to have a highest print resolution in the transport direction without causing reduction in a speed of transporting the printing paper 9.

As described above, in the printing apparatus 1, the second line head group 500, which is part of a plurality of the line head groups 400 and 500 used for the multiple printing step, includes the second line heads 50 in a larger number than the first line heads 40 belonging to the first line head group 400 as the other line head group.

Thus, in the partially high-resolution mode of the multiple printing step and the high-resolution mode of the particular printing step, implementation of high-resolution printing process is realized by using the second line head group 500. In this way, a larger number of the second line heads 50 belonging to the second line head group 500 is utilized for increasing a print resolution of an image formed by the second line head group 500 when printing process is performed at the normal transport speed. Further, increasing only the number of line heads belonging to part of the line head groups restricts size increase of the apparatus, compared to increasing the number of line heads belonging to each of the line head groups.

The particular printing step can be executed in the high-speed mode of transporting the printing paper 9 at a speed higher than that of the multiple printing step by using the second line head group 500 used also for the multiple printing step. This allows the printing apparatus 1 that executes both the multiple printing step and the particular printing step to increase a processing speed of an entire printing step without causing reduction in a print resolution.

<3. Page Break and Line Cycle>

Figure 10:
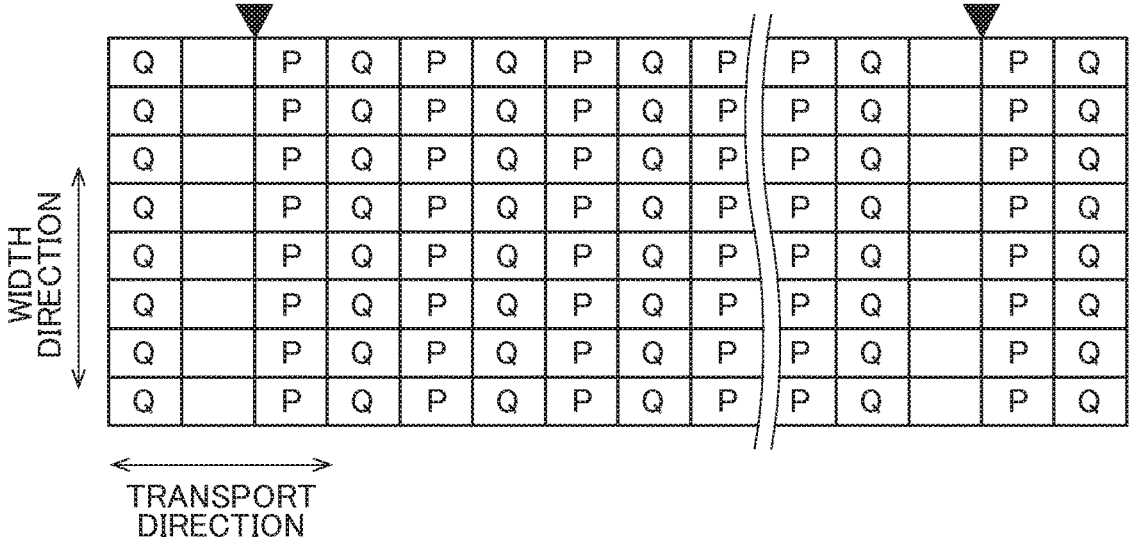
FIGS. 10 and 11 each conceptually show exemplary line arrangement on the recording medium in the normal mode of the multiple printing step.
Figure 11:
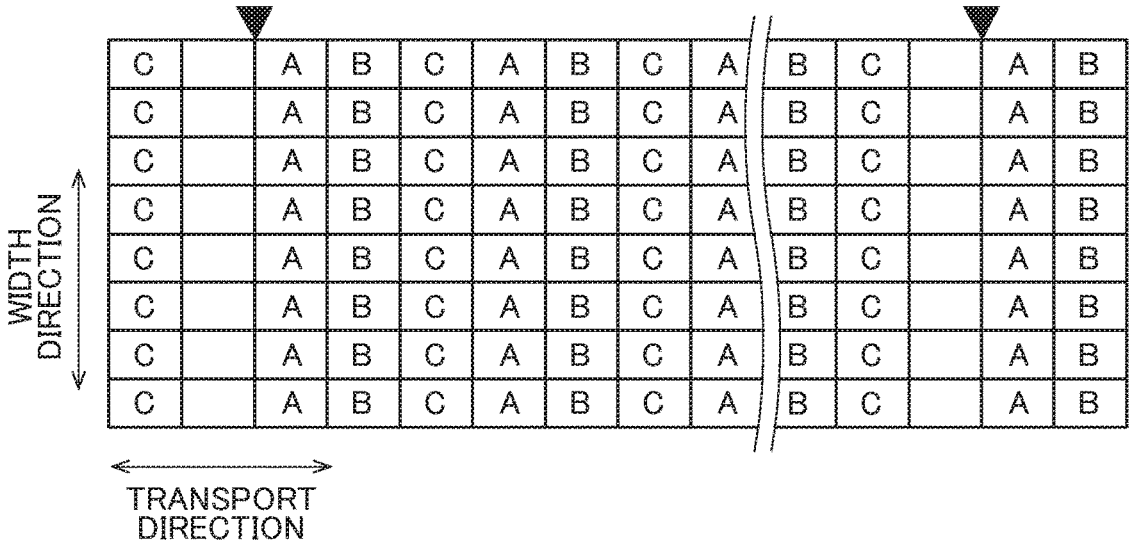
Figure 12:
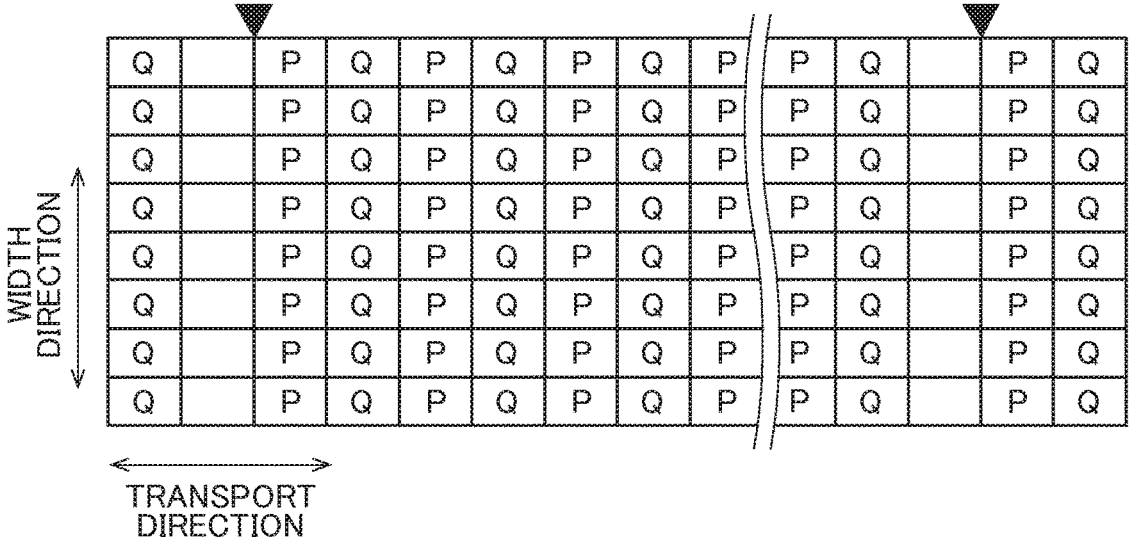
FIGS. 12 and 13 each conceptually show exemplary line arrangement on the recording medium in the partially high-resolution mode of the multiple printing step.
Figure 13:
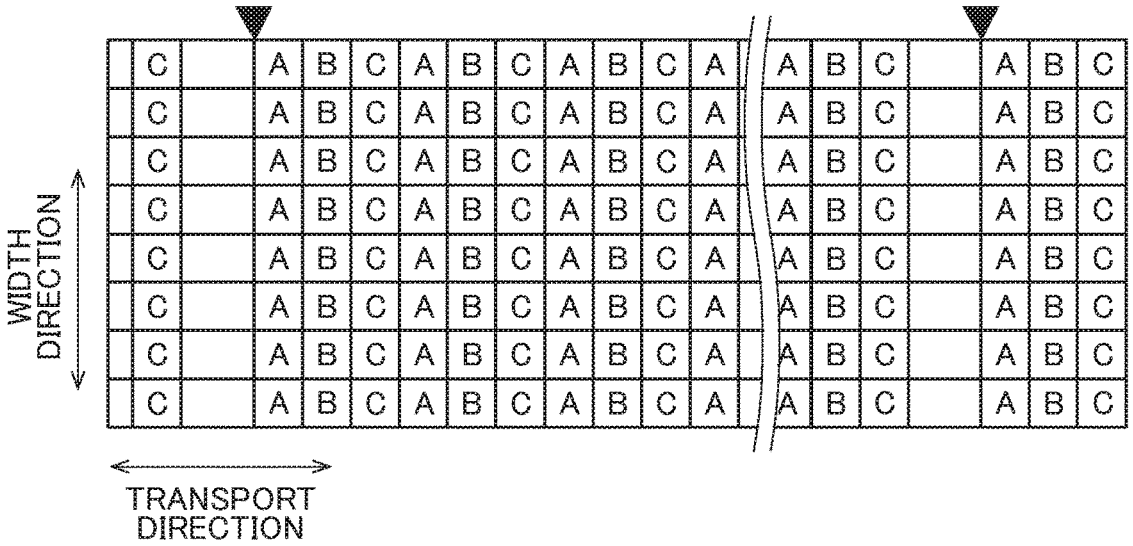

A page break and a line cycle in the multiple printing step will be described next with reference to FIGS. 4 to 7 and 10 to 13. FIGS. 10 and 11 each conceptually show exemplary line arrangement on the printing paper 9 in the normal mode of the multiple printing step. FIGS. 12 and 13 each conceptually show exemplary line arrangement on the printing paper 9 in the partially high-resolution mode of the multiple printing step. Referring to FIGS. 10 to 13, a region on the printing paper 9 to receive an ink droplet ejected from each nozzle 63 is shown as a rectangular partitioned region. Referring to FIGS. 10 to 13, page breaks on the printing paper 9 are shown by reverse triangles in black.

The normal mode of the multiple printing step will be described first with reference to FIGS. 4, 5, 10, and 11. FIG. 10 shows line arrangement determined by the first line head group 400 in the normal mode of the multiple printing step. FIG. 11 shows line arrangement determined by the second line head group 500 in the normal mode of the multiple printing step.

In the illustrations of FIGS. 4 and 5, the number of lines on one page determined by the first line head group 400 is a multiple of 2, which is the number N of lines that determines the cycle of the lines L1 including the lines Lp and the lines Lq, as shown in FIG. 4. Further, as shown in FIG. 5, the number of lines on one page determined by the second line head group 500 is a multiple of 3, which is the number M of lines that determines the cycle of the lines L2 including the lines La, the lines Lb, and the lines Lc. Thus, each page of the printing paper 9 has the same line arrangement.

As described above, in the normal mode of the multiple printing step, the number of lines on one page is preferably a common multiple of the number N of the first line heads 40 belonging to the first line head group 400 and the number M of the second line heads 50 belonging to the second line head group 500. This allows each page of the printing paper 9 to have the same line arrangement.

If lines located at the same position on different pages are handled by different line heads 40 or different line heads 50, formation of moire occurring on each page differs between these pages. This unfortunately causes difference in a print quality between the pages. Like in the illustrations of FIGS. 4 and 5, if each page of the printing paper 9 has the same line arrangement, moire occurs uniformly on each page. By doing so, a print quality is stabilized on each page.

In the illustrations of FIGS. 10 and 11, each of the number of lines on one page determined by the first line head group 400 and the number of lines on one page determined by the second line head group 500 is a common multiple of the number N of the first line heads 40 belonging to the first line head group 400 and the number M of the second line heads 50 belonging to the second line head group 500. In the illustrations of FIGS. 10 and 11, however, arranging lines on one page so as to cover an entire region in the transport direction fails to set the number of lines on each page at a common multiple of N and M. In this regard, in the illustrations of FIGS. 10 and 11, lines are arranged on one page up to a maximum number of lines corresponding to a common multiple of N and M, and a remaining region is left blank. This allows each page of the printing paper 9 to have the same line arrangement. In this way, a print quality is stabilized on each page.

The partially high-resolution mode of the multiple printing step will be described next with reference to FIGS. 6, 7, 12, and 13. FIG. 12 shows line arrangement determined by the first line head group 400 in the partially high-resolution mode of the multiple printing step. FIG. 13 shows line arrangement determined by the second line head group 500 in the partially high-resolution mode of the multiple printing step.

In the illustrations of FIGS. 6 and 7, the number of lines on one page determined by the first line head group 400 is a multiple of 2, which is the number N of lines that determines the cycle of the lines L1 including the lines Lp and the lines Lq, as shown in FIG. 6. Further, as shown in FIG. 7, the number of lines on one page determined by the second line head group 500 is a multiple of 3, which is the number M of lines that determines the cycle of the lines L2 including the lines La, the lines Lb, and the lines Lc. Thus, each page of the printing paper 9 has the same line arrangement.

As described above, in the partially high-resolution mode of the multiple printing step, the number of lines on one page determined by the first line head group 400 is preferably a multiple of the number N of the first line heads 40 belonging to the first line head group 400. Further, the number of lines on one page determined by the second line head group 500 is preferably a multiple of the number M of the second line heads 50 belonging to the second line head group 500. Specifically, the number of lines on one page of the printing paper 9 determined by the first line head group 400 and the number of lines on one page of the printing paper 9 determined by the second line head group 500 are preferably in a ratio N:M. This allows each page of the printing paper 9 to have the same line arrangement. By doing so, a print quality is stabilized on each page.

In the illustrations of FIGS. 12 and 13, the number of lines on one page determined by the first line head group 400 is a multiple of the number N of the first line heads 40 belonging to the first line head group 400. Further, the number of lines on one page determined by the second line head group 500 is a multiple of the number M of the second line heads 50 belonging to the second line head group 500. In the illustrations of FIGS. 12 and 13, arranging lines on one page so as to cover an entire region in the transport direction fails to set the number of lines on each page at each of the aforementioned multiples.

In this regard, in the illustrations of FIGS. 12 and 13, lines determined by the first line head group 400 are arranged on one page up to a maximum number of lines corresponding to a multiple of N. Further, lines determined by the second line head group 500 are arranged on one page up to a maximum number of lines corresponding to a multiple of M. A remaining region is left blank. This allows each page of the printing paper 9 to have the same line arrangement. In this way, a print quality is stabilized on each page.

<4. Modifications>

The present invention is not limited to the above-described one preferred embodiment of the present invention.

Figure 14:
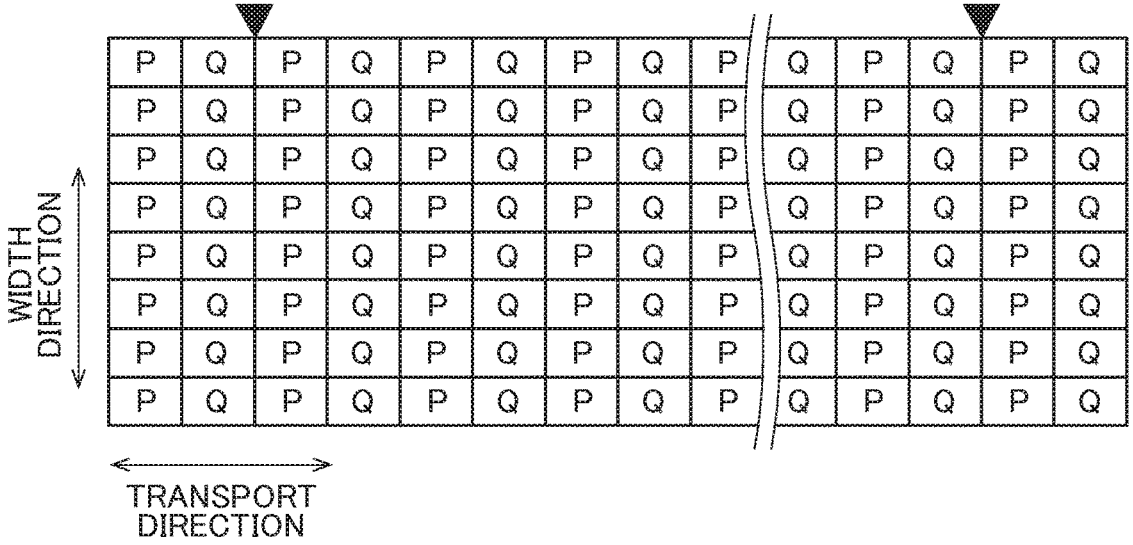
FIGS. 14 and 15 each conceptually show exemplary line arrangement on the recoding medium in the normal mode of the multiple printing step according to a modification.
Figure 15:
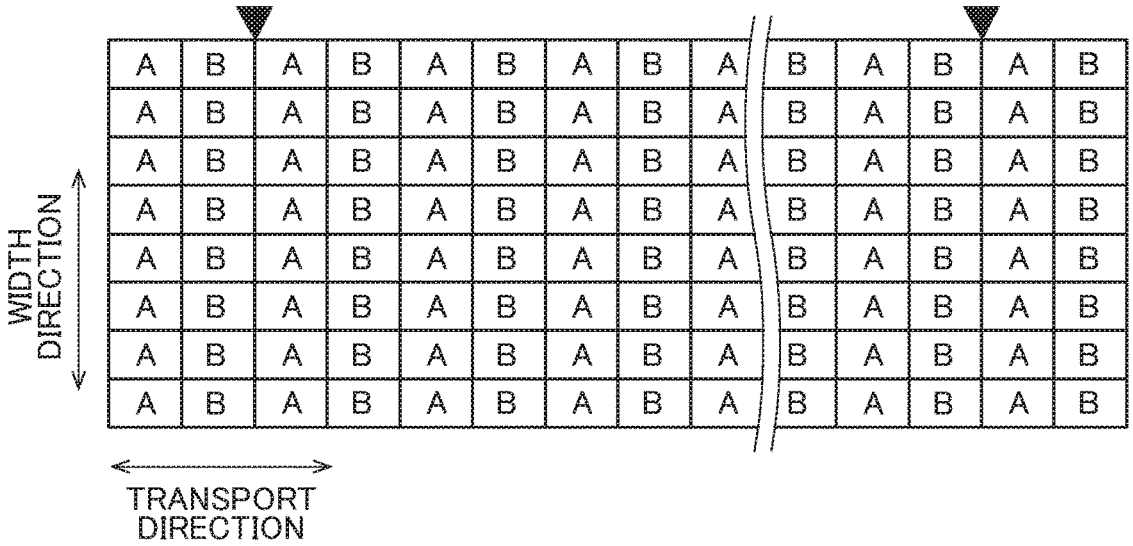

FIGS. 14 and 15 each conceptually show exemplary line arrangement on the printing paper 9 in the normal mode of the multiple printing step according to a modification. FIG. 14 shows line arrangement determined by the first line head group 400 in the normal mode of the multiple printing step. FIG. 15 shows line arrangement determined by the second line head group 500 in the normal mode of the multiple printing step.

In the illustrations of FIGS. 14 and 15, the normal mode of the multiple printing step corresponds to a fifth printing step of performing printing process by using only two of the second line heads 50 belonging to the second line head group 500. In the illustrations of FIGS. 14 and 15, the controller is allowed to make a switch at least between the partially high-resolution mode of the multiple printing step (first printing step) and the normal mode of the multiple printing step (fifth printing step).

In the normal mode of the multiple printing step illustrated in FIGS. 14 and 15, each of the two first line heads 40 performs printing process on every two lines L1. Further, two of the three second line heads 50 each perform printing process on every two lines L2. The other of the three second line heads 50 stops printing process.

By doing so, even if any of the three second line heads 50 encounters a problem such as ejection failure, a printing step can still be continued.

While a second line head 50 stops printing process, this second line head 50 may perform flushing regularly during the multiple printing step. For example, flushing may be performed by a method called line flushing of ejecting ink droplets in a linear pattern from all the nozzles 63 onto a page break of the printing paper 9 or a margin outside a printing region on a page of the printing paper 9. Flushing may alternately be performed by a method called star flushing of ejecting ink droplets from all the nozzles 63 onto corresponding ejection positions spaced from each other in a printing region of the printing paper 9 in such a manner that the ejected ink droplets are not visually noticeable. This reduces the likelihood of the occurrence of a problem such as clogging of the nozzles 63 of the second line head 50 stopping printing process with evaporated and solidified ink.

Figure 16:
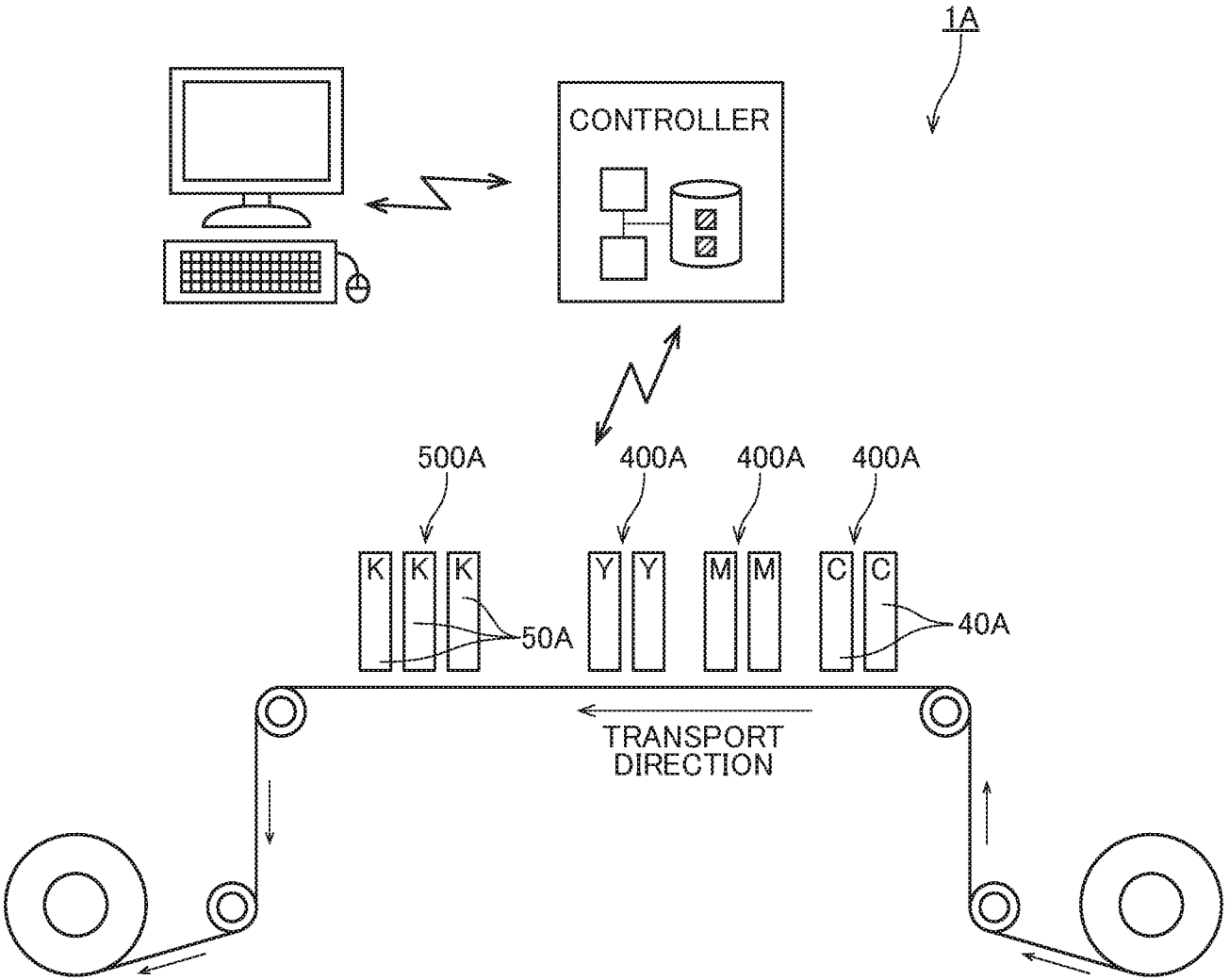
FIG. 16 conceptually shows the configuration of a printing apparatus according to a modification.

FIG. 16 conceptually shows the configuration of a printing apparatus 1A according to a different modification. The printing apparatus 1A includes six first line heads 40A and three second line heads 50A. In the printing apparatus 1A, each of the first line heads 40A and the second line heads 50A is not housed in a case together with a different line head but it forms a head unit alone.

Two of the six first line heads 40A form a first line head group 400A that ejects ink of cyan (C). Different two of the six first line heads 40A form a first line head group 400A that ejects ink of magenta (M). The other two of the six first line heads 40A form a first line head group 400A that ejects ink of yellow (Y). The three second line heads 50A form a second line head group 500A that ejects ink of black (K).

In the above-described preferred embodiment, two first line heads 40 forming the first line head group 400 are contained in one first head unit 31. Further, three second line heads 50 forming the second line head group 500 are contained in one second head unit 32. Alternatively, as illustrated in FIG. 16, each line head may be contained in a different head unit.

Figure 17:
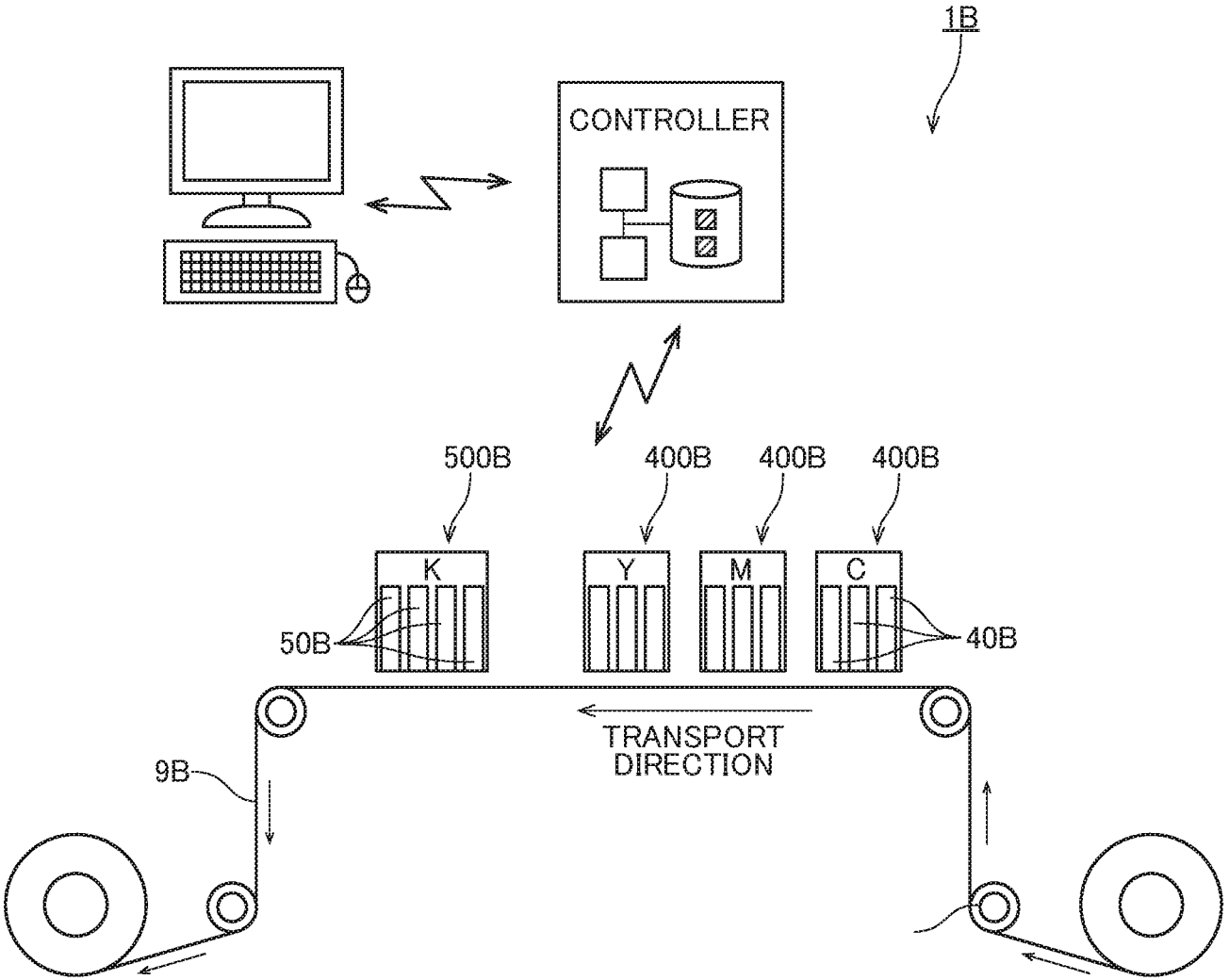
FIG. 17 conceptually shows the configuration of a printing apparatus according to a modification.

FIG. 17 conceptually shows the configuration of a printing apparatus 1B according to a different modification. The printing apparatus 1B includes three first line heads 40B belonging to one first line head group 400B, and four second line heads 50B belonging to one second line head group 500B.

In the printing apparatus 1B, a speed of transporting printing paper 9B in the high-speed mode of the particular printing step can be 4/3 times a speed of transporting the printing paper 9B in the multiple printing step. Further, in the partially high-resolution mode of the multiple printing step and the high-resolution mode of the particular printing step, a print resolution determined by the second line head group 500B can be 4/3 times a print resolution determined by the first line head group 400 in the multiple printing step.

Like in the illustration of FIG. 17, as long as the number M of the second line heads 50B belonging to the second line head group 500B is larger than the number N of the first line heads 40B belonging to the first line head group 400B, N and M may be different from those of the above-described preferred embodiment.

The printing apparatus according to the above-described preferred embodiment and the printing apparatuses according to the above-described modifications each include three first line head groups and one second line head group. However, this is not to limit the present invention. Each of the number of first line head groups and the number of second line head groups may be a different number.

For example, a first line head group may include two first line head groups responsible for cyan (C) and yellow (Y). Further, a second line head group may include two second line head groups responsible for magenta (M) and black (K). This allows full-color printing in the multiple printing step, while allowing two-color printing and single-color printing in the particular printing step.

As another example, a first line head group may include five first line head groups responsible for five types of ink of corresponding colors including cyan (C), magenta (M), yellow (Y), light cyan (LC), and light magenta (LM). Further, a second line head group may include two second line head groups responsible for two types of ink of corresponding colors including black (K) and gray (G).

The printing apparatus 1 according to the above-described preferred embodiment is allowed to execute four types of printing steps including the normal mode of the multiple printing step, the partially high-resolution mode of the multiple printing step, the high-speed mode of the particular printing step, and the high-resolution mode of the particular printing step. However, this is not to limit the present invention. The printing apparatus according to the present invention may be an apparatus that executes only some of these four types of printing steps.

The printing apparatus according to the above-described preferred embodiment and the printing apparatuses according to the above-described modifications are each an apparatus that prints an image on an elongated strip-shaped recording medium. However, the printing apparatus according to the present invention may also be a printing apparatus employing a one-by-one system by which recording media cut in units of pages are transported by a transport mechanism and images are printed on these recording media.

The printing apparatus according to the above-described preferred embodiment is an apparatus that prints an image on printing paper as a recording medium. However, the printing apparatus according to the present invention may also be an apparatus that prints a pattern such as an image on a sheet-like recording medium (a film made of resin, for example) other than a generally-used recording medium made of paper.

The components appearing in the above-described preferred embodiment and the above-described modifications may consistently be combined together, where appropriate.

While the invention has been described in detail, the foregoing description is in all aspects illustrative and not restrictive. It is understood that numerous other modifications and variations can be devised without departing from the scope of the invention.

What is claimed is:

1. An inkjet printing apparatus that performs printing process of printing an image by ejecting an ink droplet from a nozzle on a recording medium being transported, the printing apparatus comprising:

a transport mechanism that transports said recording medium in a transport direction;

a first line head group including a first line head in number of N that ejects first ink;

a second line head group including second line heads in number of M that ejects second ink; and a controller that controls the operations of said transport mechanism, said first line head, and said second line heads, wherein N is a natural number of 1 or more, M is a natural number larger than N, said first line head and said second line heads each include a plurality of nozzles aligned in a width direction, said first line head and said second line heads each form images along lines by ejecting ink droplets from said nozzles, the lines being regions extending in said width direction along a surface of said recording medium, said first line head and said second line heads are arranged to be spaced from each other in said transport direction, said controller executes a first printing step of making both said first line head group and said second line head group perform said printing process, said controller makes a switch between said first printing step and a second printing step, in said first printing step, each of said first line head in number of N performs said printing process on every N-th line out of lines on said recording medium aligned in said transport direction, in said first printing step, each of said second line heads in number of M performs said printing process on every M-th line out of said lines aligned in said transport direction, in said first printing step, an image formed by said second line head group has a print resolution in said transport direction higher than that of an image formed by said first line head group, in said second printing step, both said first line head group and said second line head group perform said printing process, and in said second printing step, an image formed by said first line head group and an image formed by said second line head group have the same print resolution in said transport direction.

2. The inkjet printing apparatus according to claim 1, wherein in said first printing step, an image formed by said second line head group has a print resolution in said transport direction that is M/N times that of an image formed by said first line head group.

3. The inkjet printing apparatus according to claim 2, wherein in said first printing step, the number of lines on one page of said recording medium along which said first line head group forms images and the number of lines on one page of said recording medium along which said second line head group forms images are in a ratio N:M.

4. The inkjet printing apparatus according to claim 3, wherein said controller makes a switch between said first printing step and a third printing step, in said third printing step, said second line head group perform said printing process while stopping said printing process by said first line head group, and a speed of transporting said recording medium employed in said third printing step is higher than that of transporting said recording medium employed in said first printing step.

5. The inkjet printing apparatus according to claim 4, wherein a speed of transporting said recording medium employed in said third printing step is M/N times that of transporting said recording medium employed in said first printing step.

6. The inkjet printing apparatus according to claim 3, wherein said controller makes a switch between said first printing step and a fourth printing step, in said fourth printing step, said second line head group perform said printing process while stopping said printing process by said first line head group, and an image formed by said second line head group in said fourth printing step has a print resolution in said transport direction higher than that of an image formed by said first line head group in said first printing step.

7. The inkjet printing apparatus according to claim 6, wherein an image formed by said second line head group in said fourth printing step has a print resolution in said transport direction that is M/N times that of an image formed by said first line head group in said first printing step.

8. The inkjet printing apparatus according to claim 1, wherein said second ink is black ink.

* * * * *